United States Patent [19]

Basore et al.

[11] Patent Number: 4,646,802

[45] Date of Patent: Mar. 3, 1987

[54] REMOVABLY-SUPPORTED HAMPER BAG AND FOLDABLE SUPPORT THEREFOR

[75] Inventors: Wayne Basore, Cordova; Susan Zander, Memphis, both of Tenn.; Arthur Kiernan, Lomoke, Ark.

[73] Assignee: Worldsbest Industries, Inc., Memphis, Tenn.

[21] Appl. No.: 832,013

[22] Filed: Feb. 24, 1986

[51] Int. Cl.[4] ..... A45C 13/04; B65B 67/12; B65D 33/02

[52] U.S. Cl. ..... 150/49; 150/51; 220/404; 232/30; 248/97; 248/99; 248/150; 383/7; 383/12; 383/33

[58] Field of Search ..... 150/49, 51, 48; 190/8, 190/1; 232/30; 383/33, 34, 9, 12, 7; 220/401, 404; 248/97, 92, 99, 95, 150; 211/132, 200, 202

[56] References Cited

U.S. PATENT DOCUMENTS

| | | | |
|---|---|---|---|
| 354,713 | 12/1886 | Lawson et al. | 150/49 |
| 526,249 | 9/1894 | Meeker | 150/49 |
| 1,533,470 | 4/1925 | Schmitt | 211/202 |
| 1,604,683 | 10/1926 | Eberhart | 150/49 X |
| 2,044,517 | 6/1936 | Thomas | 150/49 |
| 2,254,939 | 9/1941 | Elias | 248/150 |
| 2,319,384 | 5/1943 | Callan et al. | 383/33 X |
| 2,421,221 | 5/1947 | Rothe | 232/30 X |
| 2,502,323 | 3/1950 | Jackson | 150/49 |
| 2,543,243 | 2/1951 | Kliewer | 150/49 |
| 2,558,995 | 7/1951 | Tullis | 190/8 |
| 2,638,399 | 5/1953 | Seymour | 150/49 |
| 2,767,757 | 10/1956 | Marder | 150/51 |
| 3,000,416 | 9/1961 | Lindegren | 150/49 |
| 4,588,154 | 5/1986 | Basore | 150/48 X |

*Primary Examiner*—William Price
*Assistant Examiner*—Sue A. Weaver
*Attorney, Agent, or Firm*—Milton S. Gerstein; Marvin N. Benn

[57] ABSTRACT

A hamper bag is removably-mounted by a supporting base defined by a pair of opposing scissor-linkages. The hamper bag includes a pair of rods inserted through its upper lip, which rods are used to hold the hamper bag open on the supporting base by extending the rod-members over dowel-members interconnecting the upper portions of the pair of scissor-linkages, such that the rods are overhung relative to the dowel-members. The upper portions of the slats forming the scissor-linkages serve to prevent the removal of the sides and, therefore, the bag without first moving the rods away and up from the dowel-members to clear the dowel-members. The hamper bag may be carried separately or together with the collapsed supporting base.

15 Claims, 10 Drawing Figures

REMOVABLY-SUPPORTED HAMPER BAG AND FOLDABLE SUPPORT THEREFOR

BACKGROUND OF THE INVENTION

The present invention is directed to a hamper in which articles of clothing, stored for subsequent laundering, are placed in a bag supported by a stand.

Hampers are well-known. Typically, a hamper contains a storage chamber where the dirty and soiled articles of clothing are stored for laundering at a later date, which storage chamber typically is made of hard, non-flexible materials, and closed at the top by a pivotal lid, which allows selective access to the storage chamber, while preventing an unsightly appearance caused by the dirty clothing, as well as preventing the spreading of malodorous smells. When it comes time to launder the articles of clothing stored in the storage chamber, it has been necessary to first transfer the soiled and dirty, and at times malodorous, items to a secondary transfer bag or basket, which is then carried to the laundry room, or the like, where the soiled and dirty clothing articles are placed in a washing machine for cleaning. Thus, this intermediate step of transferring the articles is not only time-consuming, but can also offtimes be unpleasant. Further, since the hamper itself is stationary and generally clumsy, and since the interior of the storage chamber is not easily accessible for cleaning, conventional hampers can often become sources of unpleasant odors even without the emplacement of soiled and dirty articles of clothing in them.

An example of a removably-mounted hamper bag is disclosed in commonly-assigned applicaton Ser. No. 657,759, filed Oct. 4, 1984, now U.S. Pat. No. 4,588,154.

SUMMARY OF THE INVENTION

It is, therefore, the primary objective of the present invention to provide a hamper that readily and easily stores soiled and dirty articles of clothing, and the like, for subsequent laundering, but which obviates the secondary step of transferring the soiled and dirty articles of clothing into a secondary transfer bag or basket for subsequent transport to a laundry room, and the like.

It is a further objective of the present invention to provide a hamper that allows easy and fast removal of the storage chamber from the remainder of the structure of the hamper so that, not only can the soiled and dirty articles of clothing be transported directly to the laundry room by carrying the storage chamber itself from its stationary position attached to the hamper supporting structure, but can also allow easy replacement of the storage chamber, as well as for the fast and easy cleaning of the interior itself.

It is still another objective of the present invention to provide a hamper that can be closed by a separate and distinct cover-portion.

It is still a further objective of the present invention to allow for the very same structure to be used as a waste basket, or the like, in which appropriately-provided bags ar used, to be replaced when desired.

It is also another objective of the present invention to provide a stand upon which the removable hamper bag may be supported, which stand may be conjointly moved into a closed position along with the hamper bag, by which both the hamper bag and the supporting stand may be carried together, for removal to a laundry room, or the like.

It is still another objective of the present invention to provide the supporting stand for the hamper bag such that the supporting stand will hold open the hamper bag in an article-receiving position, in a manner that ensures that the bag stays open and does not collapse.

Toward these and other ends, the hamper bag of the present invention is provided with an upstanding supporting stand made of a pair of oppositely disposed, end-scissor linkages, which scissor-linkages are interconnected by a pair of upper dowel-members. The supporting stand may, therefore, be closed by collapsing the scissor-linkages in unison, or alternatively may be opened; the limit of movement is provided by restraining cords at the bottom of each scissor-linkage for limiting the outward, open-most position of each scissor-linkage. Each scissor-linkage further has upper protruding projections thereof extending above the plane containing therein the dowel-members interconnecting the upper portions of the end-scissor linkages. These upper, projecting portions, in cooperation with the dowels interconnecting the end-scissor linkages, allow for the hamper bag to be stored on the supporting stand such that it may not be closed without first overcoming the obstruction caused by the upper, projecting portions of the scissor-linkages.

The hamper bag proper is made of a flexible material in which is provided an upper lip having slots or channels on the longitudinally-opposed sides thereof, through which slots extend rod members, by which the hamper bag is supported on the supporting stand by the upper, projecting portions of the scissor-linkages. When mounted on the supporting stand, the hamper bag proper may be removed therefrom and closed for subsequent carrying to a laundry room, or the like. In the alternative, the hamper bag, while still attached to the supporting stand, may be collapsed along with the collapsing of the supporting stand, by simply collapsing the scissor-linkages to draw the interconecting dowel-members toward each other into abutting engagement thereof, whereby the supporting stand and the hamper bag are collapsed and, thus, may be carried together. The hamper bag is also provided with a cutout adjacent each rod-member, by which a hand may grip the rod-members, and thereby carry the bag. These very same cutouts may be used to carry both the hamper bag and the supporting stand when they are in their mutually-collapsed state, whereby both the hamper bag and its supporting stand may be carried in unison, the cutouts serving the function of allowing the carrying of the hamper bag proper, or the hamper bag proper along with the supporting stand at the same time.

A separate cover-portion is also provided by which the upper, open mouth of the hamper bag, when in its open position on the supporting stand, may be closed. The cover portion has a central-lid portion flanked by a pair of flaps that hang down over opposing sides of the support stand, whereby odors are prevented from escaping from the hamper bag. The flexible flaps allow for easy removal of the cover-lid portion from the hamper bag proper. Each flap extends over the respective interconnecting dowel-members associated with its respective side.

BRIEF DESCRIPTION OF THE DRAWINGS

The invention will be more readily understood with reference to the accompanying drawings, wherein.

DETAILED DESCRIPTION OF THE INVENTION

Figure 8:
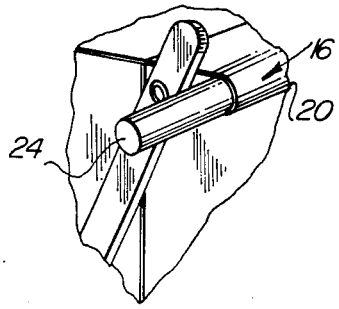
FIG. 8 is an enlarged view of the cooperation between the upper portion of an elongated slat member of a scissor-linkage and the end portion of a rod-member.
Figure 9:
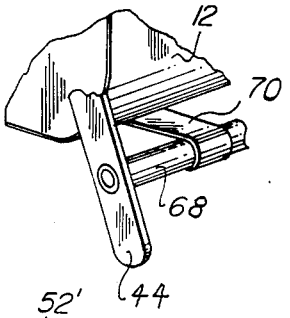
FIG. 9 is an enlarged view showing the lower portion of a scissor-linkage with a restraining member limiting the outward movement of the lower portions of the scissor-linkage to thereby define the outward-most movment thereof.

Referring now to the drawings in greater detail, the hamper bag and supporting stand therefor of the present invention is indicated generally by reference numeral 10 in the figures. The hamper bag, indicated generally by reference numeral 12, is a generally flexible bag made of flexible material, such as a thermoplastic resin, and includes an upper rim or lip portion 16 defining a pair of parallel, longitudinally-extending channels 18 and 20, as best seen in FIG. 8. Each channel 18 and 20 is formed by folding over the upper lip of the hamper bag and stitching, or otherwise attaching, the overhanging edge surface thereof to the adjoining side surface of the bag 12. The channels 18 and 20 receive therein rod-members indicated generally by reference numerals 22 and 24. Each of these rod-members is removably-mounted within its channel, so that it may slide there along, and each is of a length that is substantially greater than the length of its respective channel, so that the end portions of each rod-member may project outwardly of the associated end of its channel, as indicated by reference numerals 22', 22'', 24' and 24''. These projecting end portions of the rod-members 22 and 24 are used for mounting the bag 12 to a supporting stand described hereinbelow. The bag 12 is also formed with a pair of cutouts 30 and 32 by which one hand may be used to grip the upper portion of the hamper bag after it has been drawn together, to thereby carry the bag via the central portion of the rods 22 and 24 exposed by the cutouts, thereby providing a handle by which the bag may be carried.

The supporting stand for mounting the bag 12 and its associated rod-member 22 and 24 includes a pair of oppositely-disposed, parallel, scissor-linkages indicated by reference numerals 40 and 42. Scissor-linkage 40 is made up of a pair of intersecting, elongated slat-members 44 and 46, pivoted at the approximate center portions thereof by a pivot pin 48. The elongated slat-member 44 lies in an imaginary vertical plane spaced from an imaginary vertical plane including therein the elongated slat member 46. The scissor-linkage 42 is made up of a pair of elongated slat-members 50 and 52 intersecting at approximate center portions thereof, and pivoted together by a pivot pin. The slat-member 50 lies in an imaginary vertical plane spaced from the imaginary vertical plane containing therein the slat-member 52. Thus, the extremities of the supporting stand are defined by the elongated slats 44 and 50, which are non-parallel, but are contained in parallel planes. Thus, the distance between the outer edge-surface of slat-member 52 and the outer edge-surface of slat-member 44, taken along a perpendicular line therebetween, is the same as the perpendicular distance between the outer edge-surface of the elongated slat-member 50 and the outer edge-surface of the elongated slat-member 46. This defines an equal distance, between which respective rod-members 22 and 24 are spanned, so that each of the rods 22 and 24 may be of the exact same length and may be used along either channel 18 and 20.

Figure 1:
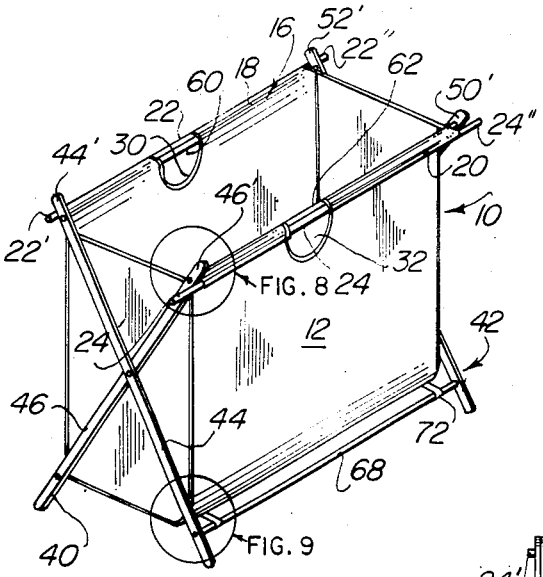
FIG. 1 is a perspective view showing the hamper bag and supporting stand therefor according to the present invention.
Figure 2:
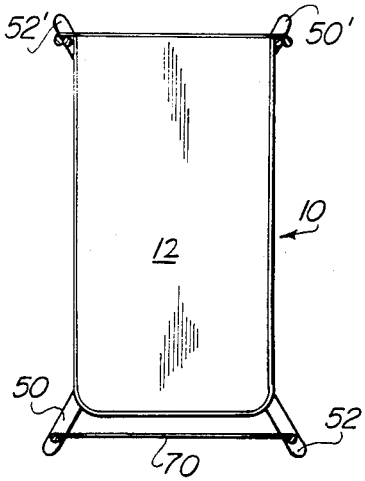
FIG. 2 is an end view, with one end scissor-linkage removed, of the hamper bag and supporting stand therefor of FIG. 1.
Figure 3:
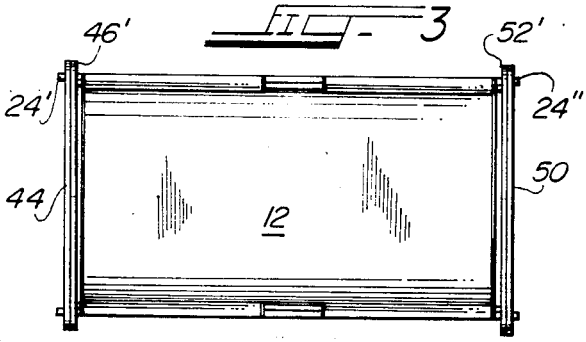
FIG. 3 is a top view of the hamper bag and supporting bag therefor of FIG. 1.
Figure 4:
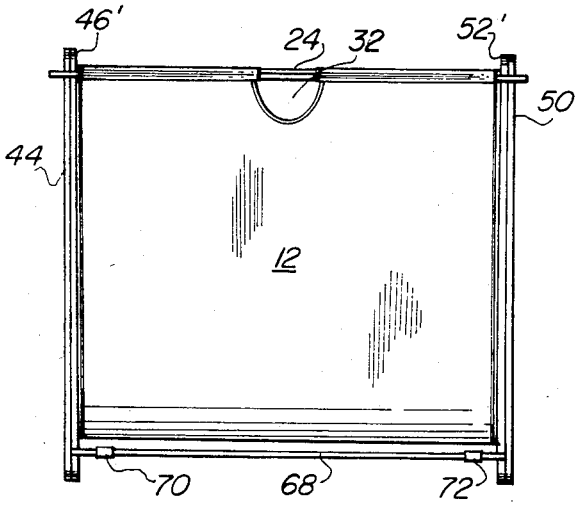
FIG. 4 is a side view of the hamper bag and supporting stand therefor of FIG. 1.
Figure 10:
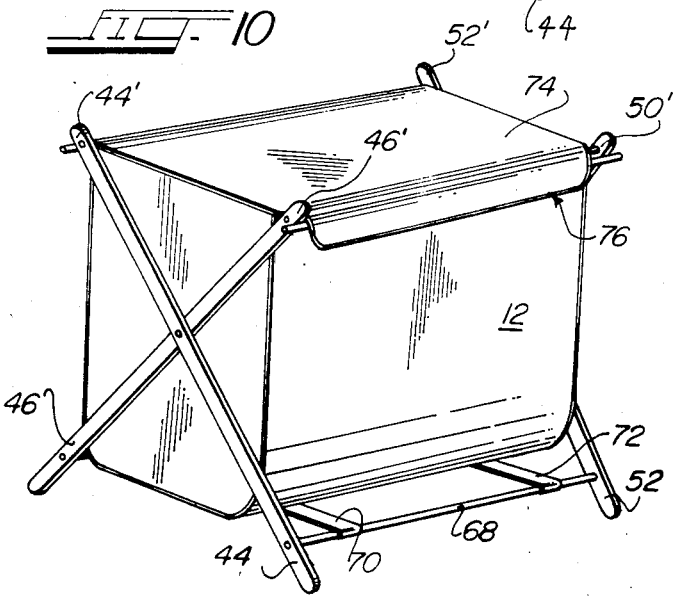
FIG. 10 is a perspective view showing the hamper bag and supporting stand therefor of FIG. 1 in combination with a cover lid, according to the present invention.

The supporting stand is further defined by a pair of upper, equal-length dowel-members 60 and 62, each of which interconnects the upper portions of parallel, elongated slat-members. The dowel-member 60 interconnects the upper portions of the parallel slat-members 44 and 52, while the dowel-member 62 interconnects the upper portions of the slat-members 46 and 50. Each of the elongated slat-members 44, 46, 50 and 52 includes an upper, tip portion that extends above the upper plane of its respective dowel-member 60 and 62. These upper tip portions 44', 46', 50' and 52' are used to retain the bag 12 in an open position by the cooperation between these upper tip portions and the associated rod-members 22 and 24, in a manner shown in FIGS. 1, 8 and 10. Each rod-member 22 and 24 is of such length as to span the distance between its associated respective upper end portions, to thereby hold in place the bag 12 on the stand and, at the same time, ensure that the bag stays open and cannot accidently become closed. This is achieved and enhanced by the fact that each of the elongated slat-members, when in their open position as shown in FIG. 1, extends at an angle, to thereby require that each rod-member 22 and 24 be moved horizontally away from its respective upper portion and upwardly therefrom in order to clear its respective upper tip portions. Thus, there cannot be any accidental closing of the bag or accidental slippage at the top thereof. It is noted that the bag 12, being made of flexible material, is of such girth so as to allow a tight fit of each rod-member 22 and 24 relative to its respective upper tip portions. However, because each elongated channel 18 and 20 is formed by an overhanging portion of the lip, the stitch line thereof provides a line about which the channel may loosely hang when mounted to the supporting stand, the rod-members 22 and 24 generally tending to take a hanging position, to thereby always be positioned in a vertical plane in which is also contained some portions of the respective upper tip portions of the parallel slats with which the respective rod-member is associated. Thus, the range and size of bags that may be accommodated by the supporting stand may vary.

Figure 5:
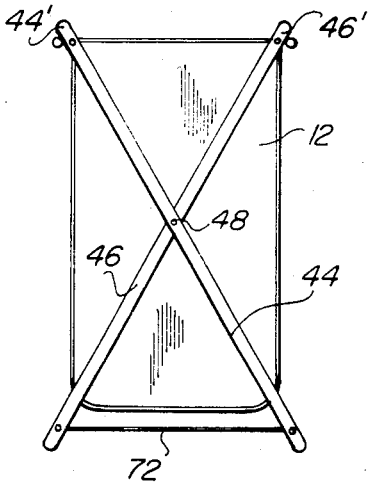
FIG. 5 is an end view of the hamper bag and supporting stand therefor of FIG. 1.
Figure 6:
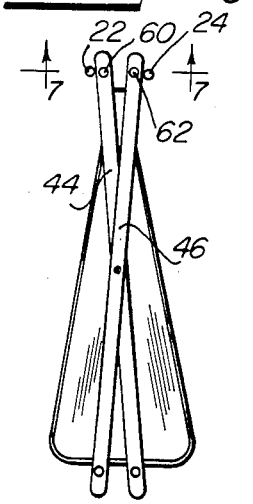
FIG. 6 is an end view of the hamper bag and supporting stand therefor of FIG. 1, showing the supporting stand with hamper bag in its closed, carry-ready position.

The supporting stand also includes a pair of lower dowel-members 66 and 68, of the same length as dowel-members 60 and 62, each of which interconnects lower portions of parallel elongated slat-members. A pair of limiting band-members 70 and 72 are also provided to limit the outward most movement of the lower leg portions of the slat-members. Each band-member 70 and 72 is connected at one end to a portion of the lower dowel-member 66, and at its other end to the corresponding portion of lower dowel-member 68, in the manner shown in FIG. 5. FIG. 6 shows the manner by which the supporting stand and hamper bag are collapsed, or moved inwardly, to a closed position, by which the whole stand and bag may be carried together to bring the laundry therein, or the like, to a desired location. To close the bag and supporting stand, one merely draws together the dowel-members 60 and 62, along with the rod-members 22 and 24 lying juxtaposed thereto, until the cutouts 30 and 32 are in such close proximity such that the hand of a person may be inserted through both, and thereby grip the dowel-members and associated rod-members together in one hand. Alternatively, one may simply remove the hamper bag from its supporting stand by simply moving the rod-members 22 and 24 from association with its respective upper portions of the slat-members. Each rod-member may be removed by simply moving it away from its respective upper portion and thereafter, upwardly, to thereby clear same. Thereafter, the two rod-members 22 and 24 are drawn toward each other until the cutouts are in close proximity, by which a hand may be inserted there through and gripped around the two rod-members. Thus, depending upon the articles stored in the bag, as well as upon the preference of the user, the bag 12 may be carried separately and independently of its supporting base, or may be carried therewith to a desired location. Carrying the bag and its supporting base together in unison has the advantages of providing a base at the location to which it is being carried without having to worry about where one will place the bag at the desired location. The advantage of carrying the bag separately, independently of the supporting base, is that it is lighter to carry and less cumbersome.

Figure 7:
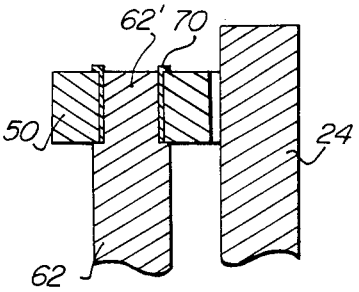
FIG. 7 is a cross-sectional view showing the mounting o the end of a dowel-member in an upper portion of one of the elongated slat members of a scissor-linkage, with the associated rod-member shown therewith.

Each dowel-member 60, 62, 66 and 68 is connected to its respective portions of the elongated slat-members by a reduced-diameter portion, such as that shown by reference numeral 62' in FIG. 7 for dowel member 62. The respective portion of the slat-member is provided wit a hole reinforced by a metal grommet for snuggly fitting therein the reduced-diameter portion 62'. This use of the metal grommet allows for the erection and collapsing of each of the dowel-members from association with its respective slat-members. Thus, at manufacture, each slat-member is independent and distinct from an associated dowel-member, and shipped such that the dowel-members are not assembled with the scissor-linkages. At erection, by a consumer, the dowel-members are simply assembled with the scissor-linkages by the insertion of the reduced-diameter portions into the respective metal-grommet, reinforced holes in the elongated slat-members. This allows for reduced space for shipping as well as reduced cost, along with the advantage of smaller-sized packaging. It is, of course, to be understood that is within the purview and scope of the present invention to provide a supporting base that is preassembled at manufacture, such that the dowel-members are fixedly connected to the scissor-linkages, without the capability of being removed therefrom.

The scissor-linkages, as well as the dowel-members and rod-members, are preferably made of wood, although other materials may be used. There is also provided a cover-lid portion, indicated by reference numeral 74 in FIG. 10. This cover-lid portion is that which is disclosed in application Ser. No. 657,759, filed Oct. 4, 1984, and is used for covering the open mouth of the hamper bag. The cover-lid portion also includes a pair of side flaps 76 that overhang the respective dowel-members and rod-members, as clearly shown in FIG. 10, so as to provide a sightly appearance, as well as for closing the hamper bag to prevent the escape of malodorous scents. Further, the side flaps 76 serve the purpose of allowing easy removal of the cover-lid portion from the hamper bag by simply grasping one flap 76 and lifting the cover-lid portion thereby. The cover-lid portion is preferably made of the same material as the hamper bag itself, such as vinyl, or the like.

While a specific embodiment of the invention has been shown and described, it is to be understood that numerous changes and modifications thereof may be made without departing from the scope, spirit and intent of the present invention as set out in the appended claims.

We claim:

1. A hamper bag and supporting stand therefor, comprising:

a bag having a hollow interior in which may be stored articles of clothing or the like; said bag comprising an upper rim portion having a first longitudinal channel formed along one longitudinal side edge-surface thereof and a second longitudinal channel formed along the other diametrically-opposed and parallel longitudinal side edge-surface thereof;

a pair of rod-members for insertion into said first and second longitudinal channels, one said rod-member for one said longitudinal channel, each of said pair of rod-members having a length substantially greater than the length of each of said first and second longitudinal channels, so that end portions of each of said pair of rod-members may project beyond the ends of the respective longitudinal channel associated therewith, whereby the end portions of each of said pair of rod-members serve to support the bag upon a supporting stand;

a supporting stand for supporting said bag thereon via said end portions of said pair of longitudinal rod-members, said supporting stand comprising a first scissor-linkage, and a second scissor-linkage spaced from said first scissor-linkage; each of said first and second scissor-linkages comprising a first elongated slat-member and a second elongated slat-member; said first and second slat-members being pivotally connected together, so as to provide a scissor-type mechanism; each of said slat-members having an upper tip portion thereof;

said supporting stand further comprising a first elongated dowel-member having a first end and a second end for interconnecting upper portions of first parallel ones of said slat-members of said first and second scissor-linkages, and a second elongated dowel-member having a first end and a second end for interconnecting upper portions of second parallel ones of said slat-members of said first and second scissor-linkages; each said elongated dowel-member being connected to its respective parallel slat-members below said upper tip portions thereof, so that said upper tip portions project upwardly beyond an imaginary horizontal plane containing therein said dowel-members;

each of said pair of rod-members having a length at least equal to the distance between the facing surfaces of said first parallel ones of said slat-members of said first and second scissor-linkages, whereby said end portions of said rod-members may serve to abut against upper portions of said slat-members of said first and second scissor-linkages;

said bag being made of a flexible material at at least the upper mouth portion thereof, so that when said bag is supported on said supporting stand, each of said pair of rod-members overhangs a respective one of said dowel-members, whereby the cooperation of said rod-member with said upper portions an with the respective said dowel-member prevents the bag from escaping therefrom and from being closed without first removing at least one of said rod-members from said supporting stand by first lifting the rod-members upward and away from the respective said upper portions and said dowel-member.

2. The hamper bag and supporting stand therefor according to claim 1, wherein said supporting stand further comprises a pair of limiting members, each said limiting member being associated with lower end portions of said first and second slat-members of a respective one of said first and second scissor-linkages, to thereby limit the outward open movement of said scissor-linkages, to provide a supporting stand upon which the bag may be emplaced.

3. The hamper bag and supporting stand accrding to claim 2, wherein said pair of limiting members comprises a first flexible band having a first end operatively connected with the lower portion of said first slat-member of said first scissor-linkage, and a second end operatively connected with the lower end portion of said second slat-member of said first scissor-linkage, and a second flexible band having a first end operatively connected with the lower end portion of said first slat-member of said second scissor-linkage, and a second end operatively connected with the lower end portion of said second slat-member of said second scissor-linkage.

4. The hamper bag and supporting stand therefor according to claim 1, further comprising a cover-lid portion having a center-portion for covering the open mouth of said bag when mounted to said supporting stand, said center-portion having a first and a second longitudinal edge-surface, and a first flexible flap-portion connected to said first longitudinal edge-surface, and a second flexible flap-portion connected to said second longitudinal edge-surface, whereby each of said flexible flap-members may freely pivot relative to its respective edge-surface, whereby said cover-lid portion may be easily removed from the mouth of said hamper bag.

5. The hamper bag and supporting stand therefor according to claim 1, wherein each of said pair of rod-memberrs is removably, slidingly mounted in one of said first and second elongated channel-members, so that each of said rod-members may be removed from its respective said elongated channel-member when so desired.

6. The hamper bag and supporting stand therefor according to claim 5, wherein said hamper bag further comprises a first cutout on one upper side surface portion thereof directly adjcent to a center portion of said first elongated channel-member, and a second cutout on the other upper side surface portion thereof directly adjacent to a center portion of said second elongated channel-member, said first and second cutouts allowing for the carrying of said bag by one hand by the insertion thereof through said cutouts, said rod-members providing a handle-portion thereby.

7. A hamper bag and supporting stand therefor, comprising:

a bag having a hollow interior in which may be stored articles of clothing or the like; said bag comprising an upper rim portion having a first longitudinal side edge-surface thereof and a second diametrically-opposed and parallel longitudinal side edge-surface thereof;

a pair of rod-members, each of said pair of rod-members being secured to one of said longitudinal side edge-surfaces, each of said pair of rod-members having a length substantially greater than the length of each of said first and second longitudinal side edge-surfaces, so that end portions of each of said pair of rod-members may project beyond the ends of the respective longitudinal side edge-surfaces associated therewith, whereby the end portions of each of said pair of rod-members serve to support the bag upon a supporting stand;

a supporting stand for supporting said bag thereon via said end portions of said pair of longitudinal rod-members, said supporting stand comprising a first scissor-linkage, and a second scissor-linkage spaced from said first scissor-linkage; each of said first and second scissor-linkages comprising a first elongated slat-member and a second elongated slat-member; said first and second slat-members being pivotally connected together, so as to provide a scissor-type mechanism; each of said slat-members having an upper tip portion thereof;

said supporting stand further comprising a first elongated dowel-member having a first end and a second end for interconnecting upper portions of first parallel ones of said slat-members of said first and second scissor-linkages, and a second elongated dowel-member having a first end and a second end for interconnecting upper portons of second parallel ones of said slat-members of said first and second scissor-linkages; each said elongated dowel-member being connected to its respective parallel slat-members below said upper tip portions thereof, so that said upper tip portions project upwardly beyond an imaginary horizontal plane containing therein said dowel-members;

each of said pair of rod-members having a length at least equal to the distance between the facing surfaces of said first parallel ones of said slat-members of said first and second scissor-linkages, whereby said end portions of said rod-members may serve to abut against upper portions of said slat-members of said first and second scissor-linkages;

said bag being made of a flexible material at at least the upper mouth portion thereof, so that when said bag is supported on said supporting stand, each of said pair of rod-members overhangs a respective one of said dowel-members, whereby the cooperation of said rod-member with said upper portions and with the respective said dowel-member prevents the bag from escaping therefrom and from being closed without first removing at least one of said rod-members from said supporting stand by first lifting the rod-members upward and away from the respective said upper portions and said dowel-member.

8. The hamper bag and supporting stand therefor according to claim 7, wherein said supporting stand further comprises a first lower dowel-member interconnected between lower end portions of said one parallel slat-members of said first and second scissor-linkages, and a second lower dowel-member parallel to said firrst lower dowel-member and interconnected between lower end portions of said other parallel slat-members of said first and second scissor-linkages; and further comprising a first limiting member having a first end connected to a portion of said first lower dowel-member adjacent to said first scissor-linkage, and a second end connected to a portion of said second lower dowel-member adjacent said first scissor-linkage.

9. The hamper bag and supporting stand therefor according to claim 8, further comprising a second limiting member having a first end connected to a portion of said first lower dowel-member adjacent to said second scissor-linkage, and a second end connected to a portion of said second lower dowel-member adjacent said second scissor-linkage, whereby the outward open movement of said scissor-linkages is limited.

10. The hamper bag and supporting stand therefor according to claim 7, further comprising a cover-lid portion having a center-portion for covering the open mouth of said bag when mounted to said supporting stand, said center-portion having a first and a second longitudinal edge-surface, and a first flexible flap-portion connected to said first longitudinal edge-surface, and a second flexible flap-portion connected to said second longitudinal edge-surface, whereby each of said flexible flap-members may freely pivot relative to its respective edge-surface, whereby said cover-lid portion may be easily removed from the mouth of said hamper bag.

11. The hamper bag and supporting stand therefor according to claim 7, wherein each of said pair of rod-members is removably, slidingly mounted in one of said first and second longitudinal side edge-surfaces, so that each of said rod-members may be removed from its respective said longitudinal side edge-surface when so desired.

12. The hamper bag and supporting stand therefor according to claim 11, wherein said hamper bag further comprises a first cutout on one upper side surface portion thereof directly adjacent to a center portion of said first longitudinal side edge-surface, and a second cutout on the other upper side surface portion thereof directly adjacent to a center portion of said second longitudinal side edge-surface, said first and second cutouts allowing for the carrying of said bag by one hand by the insertion thereof through said cutouts, said rod-members providing a handle-portion thereby.

13. The hamper bag and supporting stand therefor according to claim 7, wherein each of said first and second elongated dowel-members is removably mounted its respective said slat-members, each said slat member comprising an upper hole reinforced with a grommet for receiving therein a respective end portion of a dowel-member, so that said scissor-linkages and said dowel-members may be shipped unassembled.

14. The hamper bag and supporting stand therefor according to claim 13, wherein each said end portion of each said dowel-member is a reduced-diameter portion having a diametric expanse less than the portion of the dowel-member between the end portions so as to provide an abutment against which the surface of the respective slat-member abuts.

15. The hamper bag and supporting stand according to claim 7, wherein the perpendicular distance between said first parallel ones of said slat-members is equal to the perpendicular distance between said second parallel ones of said slat-members, so that one of said first parallel ones of said slat-members constitutes one outer limit of the bounds of said supporting stand, while one of the other of said second parallel ones of said slat-members constitutes the other outer limit of the bounds of said supporting stand, whereby the same length of rod members may be used at each of said first and second longitudinal side edge-surfaces.

* * * * *